US006727858B2

(12) United States Patent
Iijima

(10) Patent No.: US 6,727,858 B2
(45) Date of Patent: Apr. 27, 2004

(54) CIRCULARLY POLARIZED WAVE ANTENNA SUITABLE FOR MINIATURIZATION

(75) Inventor: Kouta Iijima, Fukushima-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 30 days.

(21) Appl. No.: 10/246,163

(22) Filed: Sep. 17, 2002

(65) Prior Publication Data

US 2003/0058170 A1 Mar. 27, 2003

(30) Foreign Application Priority Data

Sep. 21, 2001 (JP) ..... 2001-289666

(51) Int. Cl.[7] ..... H01Q 1/38
(52) U.S. Cl. ..... 343/702; 343/826
(58) Field of Search ..... 343/700 MS, 702, 343/797, 895, 826

(56) References Cited

U.S. PATENT DOCUMENTS 4,479,127 A * 10/1984 Barbano ..... 343/742
5,442,366 A * 8/1995 Sanford ..... 343/700 MS
6,522,302 B1 * 2/2003 Iwasaki ..... 343/726

FOREIGN PATENT DOCUMENTS

JP 2000-196310 7/2000

* cited by examiner

*Primary Examiner*—Michael C. Wilmer
(74) *Attorney, Agent, or Firm*—Brinks Hofer Gilson & Lione

(57) ABSTRACT

A circularly polarized wave antenna is constructed such that the circularly polarized wave antenna has four flat plate-shaped dielectrics having the substantially same thickness vertically provided on a printed substrate and arranged in a square-cylinder shape as a whole, and four radiation conductors provided, on each outer wall surface of the flat plate-shaped dielectrics, inclined in a fixed direction, such that a lower end of each of the radiation conductors is electrically connected to the printed substrate and such that electric power is fed to the four radiation conductors in phase.

6 Claims, 5 Drawing Sheets

CIRCULARLY POLARIZED WAVE ANTENNA SUITABLE FOR MINIATURIZATION

BACKGROUND OF THE INVENTION

1. Detailed Description of the Invention

The present invention relates to a circularly polarized wave antenna for use in communication between a stationary satellite and a movable body.

2. Description of the Prior Art

Since in a system for communicating with the stationary satellite or receiving satellite broadcasting in a movable body such as an automobile, a circularly polarized wave is mainly used, there is desired a small-sized circularly polarized wave antenna through which an excellent circularly polarized wave can be obtained within a wide range of angle of elevation.

FIG. 6 shows a conventional example of this sort of circularly polarized wave antenna, and FIG. 6A is a perspective view showing a circularly polarized wave antenna; and FIG. 6B is a side view showing the circularly polarized wave antenna. This circularly polarized wave antenna 101 is composed of a ground plate 102 and four conductors 103. These conductors 103 are obtained by extending a central conductor of a coaxial cable 104. Also, an outer conductor of the coaxial cable 104 is soldered to the ground plate 102 at a soldered point 105 as shown. Accordingly, each conductor 103 is fixed onto the ground plate 102 like a cantilever. Also, each conductor 103 is arranged on the ground plate 102 at regular intervals d, and inclines at a predetermined angle $\alpha$ in the same direction respectively.

In the circularly polarized wave antenna 101 constituted as described above, electric power is fed to those four conductors 103 in phase to create a phase difference of 90° in space, whereby the main beam faces a certain angle of elevation, a circularly polarized wave can be emitted in that direction, and further a pattern of a conical surface at the angle of elevation becomes non-directional. In other words, the directivity of the circularly polarized wave antenna 101 becomes as shown in FIG. 7 even if viewed from any of the azimuth angle directions, and if the stationary satellite 107 is positioned on an extension line of an oblique line 106, the directivity of the circularly polarized wave antenna 101 can always be directed toward the stationary satellite 107 in whichever direction the movable body equipped with the circularly polarized wave antenna 101 may advance. In this case, when the target angle of elevation is within, for example, a range of 30° to 60°, if an angle of inclination a of the conductor 103 is set to about 45°, the length L of the conductor 103 is set to about 0.65 $\lambda_0$, an interval d between two conductors 103 in opposite to each other is set to about 0.33 $\lambda_0$, then the optimum directivity to the angle of elevation can be obtained (where $\lambda_0$ is free space wave length of the radio wave for use)

Since the above-described conventional circularly polarized wave antenna 101 has been constructed such that four conductors 103 which have been inclined by about 45° are arranged on the ground plate 102 at a regular interval d so as to feed electric power to each conductor 103 in phase, there is no need for any automatic phase shifter and the like on feeding electric power and there is an advantage that the structure can be simplified. However, the structure is not without its problems. More specifically, since four conductors 103 (about 0.65 $\lambda_0$ in length) inclined by about 45° are arranged at a regular interval d (about 0.33 $\lambda_0$), the overall dimension of the circularly polarized wave antenna 101 becomes 0.33 $\lambda_0$×0.33 $\lambda_0$×0.46 $\lambda_0$, when the frequency for use is, for example, 2.3 GHz ($\lambda_0$=130 mm), becomes as large as up to about 43×43×60 (mm), and miniaturization as a vehicle-mounted antenna cannot be realized. Also, since each conductor 103 is only fixed onto the ground plate 102 in a cantilever shape and has low mechanical strength, there is a problem that the interval between each conductor 103 fluctuates because of vibration of the automobile to deteriorate the antenna characteristics or great stress is applied to a soldered point 105 of an outer conductor of the coaxial cable 104 to cause a poor connection.

SUMMARY OF THE INVENTION

The present invention has been achieved in views of the prior art as such, and is aimed to provide a circularly polarized wave antenna at low prices which is suitable for miniaturization and is also resistant to vibrations.

As solution means for achieving the above-described object, there is provided a circularly polarized wave antenna, according to the present invention, having four flat plate-shaped dielectrics having the substantially same thickness vertically provided on a printed substrate and arranged in a square-cylinder shape as a whole, and four radiation conductors provided on each outer wall surface of these flat plate-shaped dielectrics inclined in a fixed direction, characterized in that the structure is arranged such that a lower end of each of the above-described radiation conductors is electrically connected to the printed substrate and such that electric power is fed to these four radiation conductors in phase.

In a circularly polarized wave antenna constructed as described above, since there are provided radiation conductors on each outer wall surface of four flat plate-shaped dielectrics arranged in a square cylinder shape, a mechanical orthogonal relationship of each radiation conductor is retained so that not only deterioration in the antenna characteristics and the poor connection resulting from external vibrations can be reduced but also the required length of the radiation conductor becomes short by a shortened wavelength due to the flat plate-shaped dielectric having high specific inductive capacity, and as a result, substantial miniaturization can be realized. Also, since the flat plate-shaped dielectric is not likely to unevenly contract in a calcination process during manufacture, it is also easy to perform fine adjustment of the plate thickness and the like by polishing after the calcination, it becomes easy to prevent variations in the antenna characteristics resulting from dimensional error or the like. Further, since it is easy to print the radiation conductor on a flat surface which serves as the outer wall surface of the flat plate-shaped dielectric, not only is it possible to easily form a desired radiation conductor by raising the printing precision but also it is possible to collectively print and form the radiation conductor on a multiplicity of flat plate-shaped dielectrics having the substantially same thickness. Therefore, the printing cost can be significantly reduced.

Also, if, in the above-described structure, of a pair of flat plate-shaped dielectrics adjacent substantially at right angles, a protrusion for protruding from the side of one flat plate-shaped dielectric by a portion corresponding to the plate thickness is fitted into a recess obtained by cutting a portion corresponding to the plate thickness in the side of the other flat plate-shaped dielectric, it will be possible to combine four flat plate-shaped dielectrics having the same width dimension in a square-cylinder shape at a layout of a substantial square. Therefore, it becomes easier to design and perform an assembly operation.

Further, if, in the above-described structure, those four flat plate-shaped dielectrics are all of the same shape, the manufacturing cost can also be significantly reduced. In this case, if an upper half of one side and a lower half of the other side of the flat plate-shaped dielectric are cut by a portion corresponding to the plate thickness along the direction of the width, it is possible to adopt a structure preferable in design in which a protrusion of one flat plate-shaped dielectric adjacent substantially at right angles is fitted into a recess in the other flat plate-shaped dielectric whereby four flat plate-shaped dielectrics are combined in a square-cylinder shape in a layout of a square as well as it is possible to remarkably enhance the dimensional precision because the protrusion concerned and the recess concerned have the same contraction condition in the calcination process.

DETAILED DESCRIPTION OF THE PREFERRED EMBODIMENTS

Figure 1:
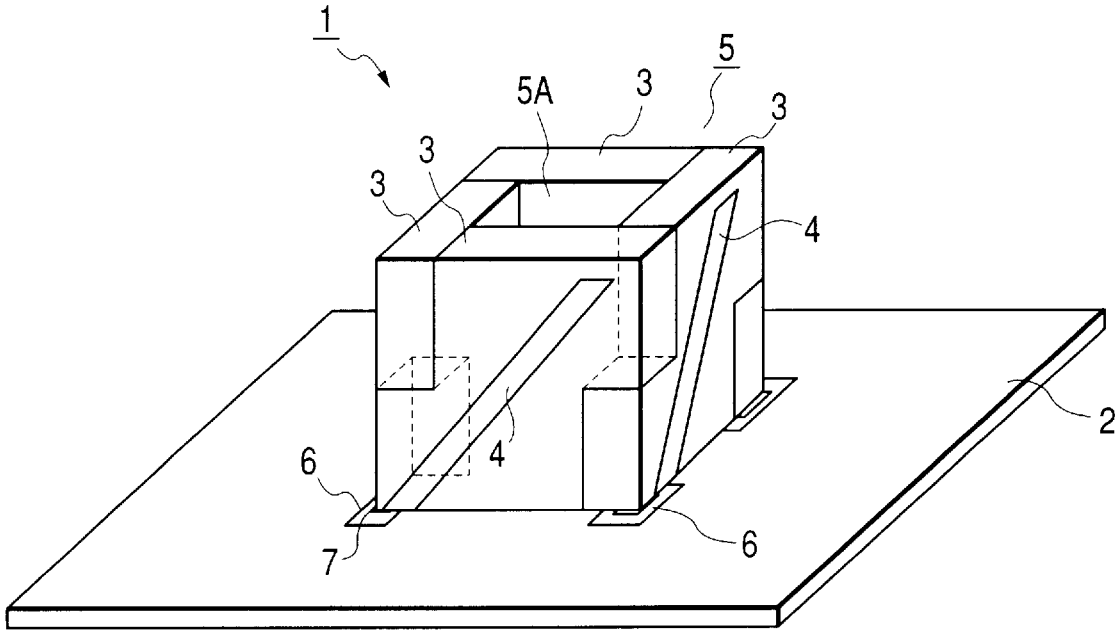
FIG. 1 is a perspective view showing a circularly polarized wave antenna according to a first embodiment.
Figure 2:
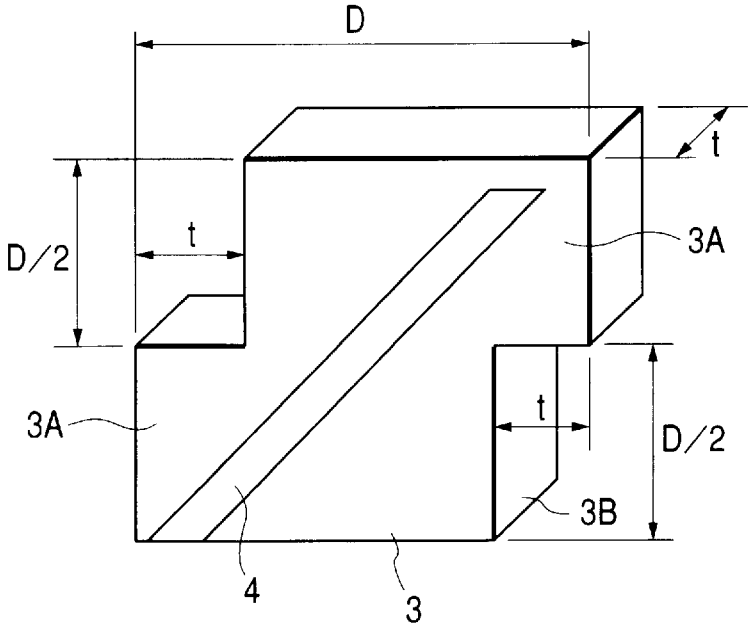
FIG. 2 is a perspective view showing a flat plate-shaped dielectric according to the first embodiment.

With reference to the drawings, the description will be made of an embodiment of the invention. FIG. 1 is a perspective view showing a circularly polarized wave antenna according to the first embodiment of the present invention, FIG. 2 is a perspective view showing a flat plate-shaped dielectric constituting the circularly polarized wave antenna concerned, and FIG. 3 is a plan view for a printed substrate for feeding electric power to the circularly polarized wave antenna concerned.

In FIG. 1, a reference numeral 1 collectively designates a circularly polarized wave antenna. This circularly polarized wave antenna 1 is composed of: a printed substrate 2, four flat plate-shaped dielectrics 3 and a radiation conductor 4 formed on each flat plate-shaped dielectric 3. Those four flat plate-shaped dielectrics 3 are all of the same shape, and any of them is obtained by forming dielectric material such as ceramic into such a shape as shown in FIG. 2. These flat plate-shaped dielectrics 3 are arranged in a square-cylinder shape as a whole, and are fixed onto the printed substrate 2 through the use of adhesive or the like. More specifically, in each flat plate-shaped dielectric 3, an upper half of one side thereof and a lower half of the other side are cut by a portion corresponding to the plate thickness t along the direction of the width, and a protrusion 3A of one flat plate-shaped dielectric 3 adjacent substantially at right angles is fitted into a recess 3B in the other flat plate-shaped dielectric 3, whereby those four flat plate-shaped dielectrics 3 are combined in a layout of a square to constitute a rectangular cylindrical body 5. This rectangular cylindrical body 5 is shaped with a penetration hole 5A extending in the direction of the axis provided in a square (length of its one side is D−2t) when the plane is viewed at the center of a cube, the length of one side of which is D. Also, on a surface which serves as the outer wall surface of each flat plate-shaped dielectric 3, there has been formed a radiation conductor 4 inclined by about 45° in advance by means of technique such as printing.

Figure 3A:
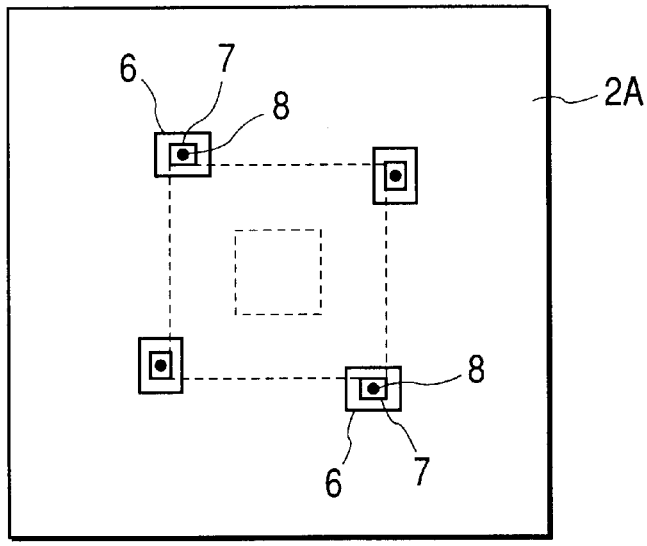
FIG. 3 is a plan view for a printed substrate shown in FIG. 1.
Figure 3B:
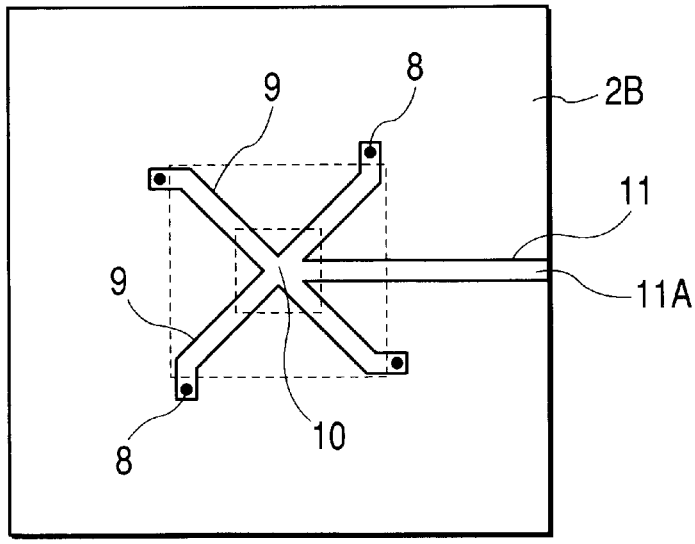

A surface 2A of the printed substrate 2 for feeding electric power to the circularly polarized wave antenna 1 has become a grounded surface over the substantially entire surface by means of copper foil or the like as shown in FIG. 3A, and rectangular cutouts 6 are formed at four places on this surface 2A. Inside each cutout 6, there is formed a feed electrode 7, and the feed electrode 7 is connected to a micro strip line 9 in an underside 2B of the printed substrate 2 through a through-hole 8 as shown in FIG. 3B. Thus, the lower ends of a total of four radiation conductors 4 formed on the outer wall surface of each flat plate-shaped dielectric 3 are connected to each feed electrode 7 of the printed substrate 2 respectively by means of soldering or the like. Also, at the underside 2B of the printed substrate 2, four micro strip lines 9 formed so as to include the through-hole 8 are designed to have the same distance between their intersection 10 and each through-hole 8. From the intersection 10, further one micro strip line 11 is extended and formed, and an end 11A of this micro strip line 11 is connected to an RF amplifier and the like (not shown). Thereby, electric power is fed to those four radiation conductors 4 in phase.

Even in the circularly polarized wave antenna 1 constructed as described above, the length of the radiation conductor 4 and the interval between those two radiation conductors 4 opposite to each other have been set in the same manner as in the conventional example described above. In other words, the length L1 of the radiation conductor 4 becomes $L1=0.65\cdot\lambda1$ when the wave length of the radio wave in the flat plate-shaped dielectric 3 is assumed to be $\lambda1$. Also, the interval D between those two radiation conductors 4 opposite to each other requires at least $L1/\sqrt{2}$ because the radiation conductor 4 inclines about 45°. This interval D is equal to the length of one side of the rectangular cylindrical body 5, and when the wave length of the radio wave in the dielectric which corresponds to equivalent specific inductive capacity when air layer within the penetration hole 5A is added to the rectangular cylindrical body 5 is assumed to be $\lambda2$, a relationship of $D=0.33\cdot2$ must be satisfied. In this respect, a relationship of $\lambda2>\lambda1$ is always satisfied because of the existence of the air layer (specific inductive capacity 1) within the penetration hole 5A, and if the plate thickness of the flat plate-shaped dielectric 3 is reduced and the penetration hole 5A is enlarged, the value of $\lambda2$ can be reduced.

In the case where the specific inductive capacity of the flat plate-shaped dielectric 3 is 35 as an example, if the free space wave length of the radio wave for use is $\lambda_0$, a conditional expression will be satisfied when the length D−2t of one side of the penetration hole 5A is set to about 0.08 $\lambda_0$ and the length D of one side of the rectangular cylindrical body 5 is set to about 0.18 $\lambda_0$. Therefore, the plate thickness t of the flat plate-shaped dielectric 3 can be set to about 0.1 $\lambda_0$ and the overall dimensions of the circularly polarized wave antenna 1 can be set to about 0.18 $\lambda_0\times0.18\ \lambda_0\times0.18\ \lambda_0$. Accordingly, when the frequency of the radio wave for use is assumed to be 2.3 GHz ($\lambda_0$=130 mm) in the same manner as the conventional example described above, the overall dimensions of the circularly polarized wave antenna 1 comprising flat plate-shaped dielectrics 3, each having the plate thickness of about 13 mm, combined becomes about 23×23×23 (mm), and it can be seen that substantial miniaturization can be realized.

An operation of the circularly polarized wave antenna 1 described above is basically the same as the conventional example described above. In other words, two radiation conductors 4 which generate polarized waves for intersecting at right angles in space are arranged at a distance away to generate a phase difference of 90° and both radiation conductors 4 are energized at the same amplitude, whereby circularly polarized waves are obtained. Thus, these radiation conductors 4 which make a pair are prepared in two pairs (four in total) and are arranged so as to intersect at right angles, whereby uniform circularly polarized waves are adapted to be obtained all around in the azimuth angle direction.

Since the circularly polarized wave antenna 1 according to the present embodiment is provided with radiation conductors 4 on each side of the rectangular cylindrical body 5 as described above, a mechanical orthogonal relationship of each radiation conductor 4 is retained so that deterioration in the antenna characteristics and the poor connection resulting from external vibrations can be reduced. Also, since the flat plate-shaped dielectric 3 constituting the rectangular cylindrical body 5 is made of a dielectric material having high specific inductive capacity, the length required for the radiation conductor 4 becomes shorter because of the shortened wavelength thereof, and as a result, the circularly polarized wave antenna 1 can be remarkably miniaturized. Moreover, since the flat plate-shaped dielectric 3 is not likely to unevenly contract in a calcination process during manufacture, it is also easy to perform fine adjustment of the plate thickness and the like by polishing after the calcination, it becomes easy to prevent variations in the antenna characteristics resulting from dimensional error or the like. Further, since it is easy to print the radiation conductor 4 on a flat surface which serves as the outer wall surface of the flat plate-shaped dielectric 3, it is possible to easily form the radiation conductor 4 desirably, and to collectively print and form the radiation conductor 4 on a multiplicity of flat plate-shaped dielectrics 3 having the same thickness. Therefore, the printing cost can be significantly reduced.

Particularly, in the case of the present embodiment, since the flat plate-shaped dielectrics 3 having the same shape are combined to constitute the rectangular cylindrical body 5, the flat plate-shaped dielectrics 3 are produced in quantity, whereby the manufacturing cost can be significantly reduced. Also, a protrusion 3A of one flat plate-shaped dielectric 3 adjacent substantially at right angles is fitted into a recess 3B in the other flat plate-shaped dielectric 3, whereby those four flat plate-shaped dielectrics 3 are arranged in a square shape when the plane is viewed. Therefore, it is easy to design and perform the assembly operation, and the dimensional precision can also be remarkably enhanced because the protrusion 3A and the recess 3B have the same contraction condition in the calcination process.

Figure 4:
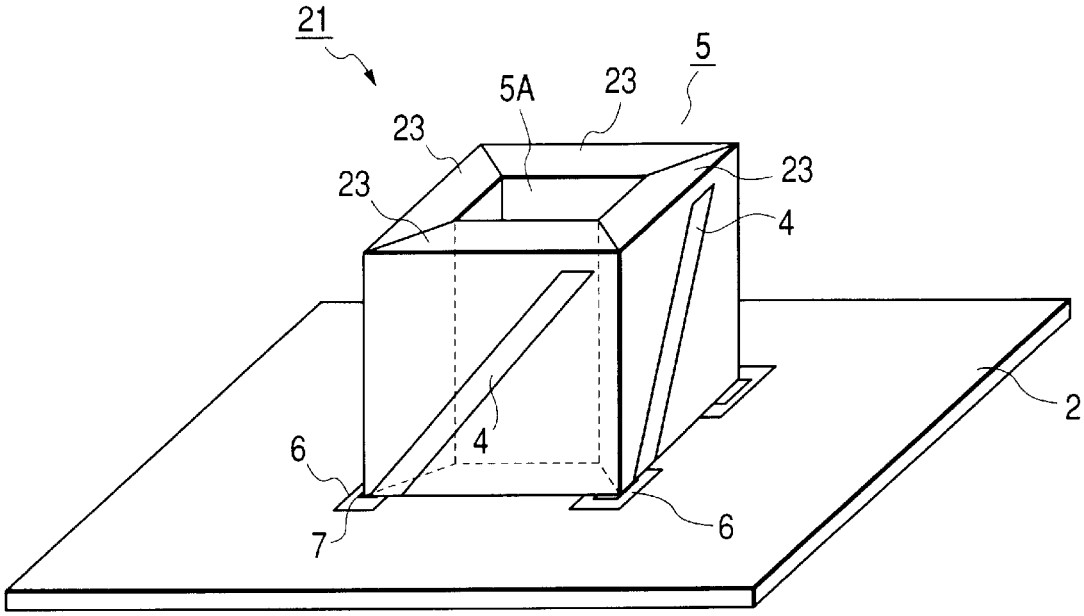
FIG. 4 is a perspective view showing a circularly polarized wave antenna according to a second embodiment.
Figure 5:
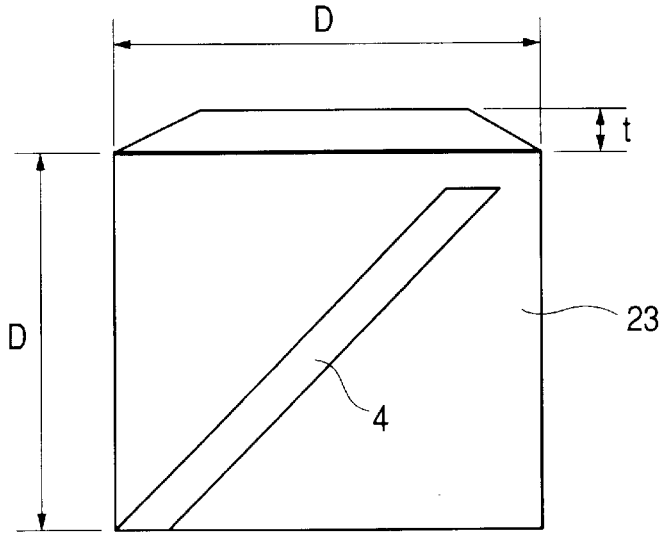
FIG. 5 is a perspective view showing a flat plate-shaped dielectric according to the second embodiment.
Figure 6A:
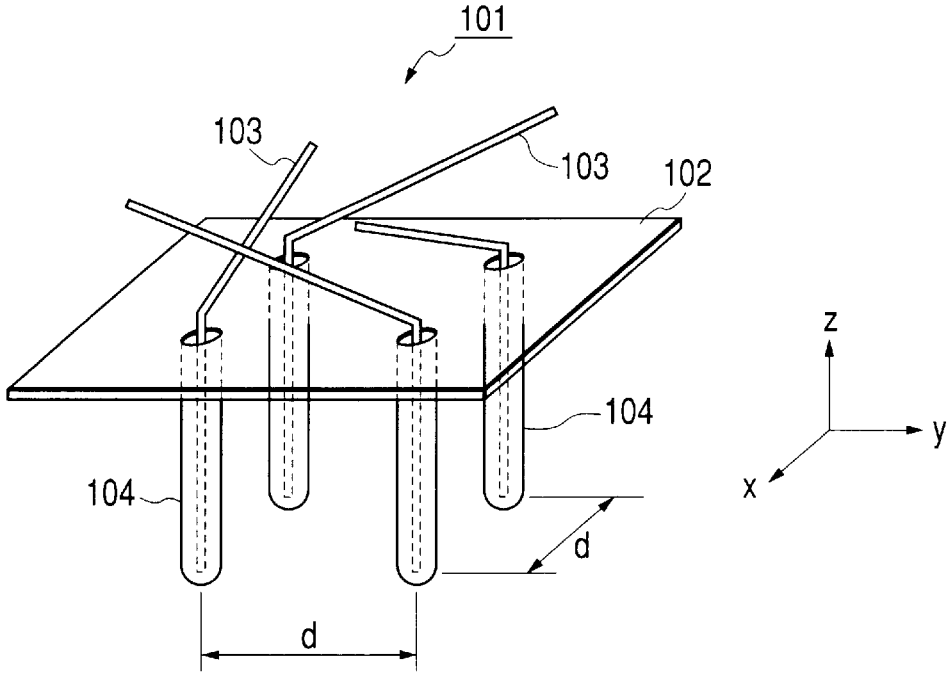
FIG. 6A PRIOR ART
FIGS. 6A and 6B are a perspective and side view, respectively, showing a circularly polarized wave antenna according to a conventional example.
Figure 6B:
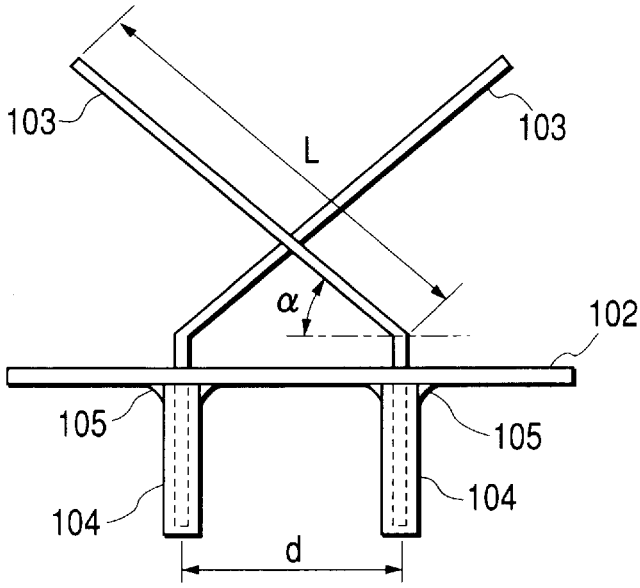
FIG. 6B PRIOR ART
Figure 7:
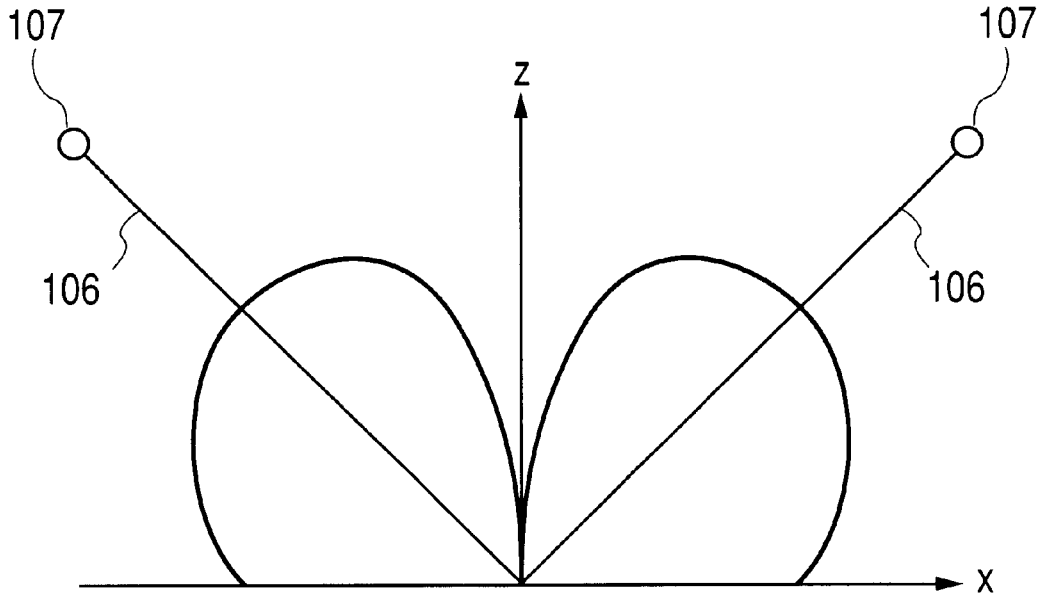
FIG. 7 is an explanatory view illustrating directivity of the circularly polarized wave antenna.

FIG. 4 is a perspective view showing a circularly polarized wave antenna according to the second embodiment of the present invention, FIG. 5 is a perspective view showing flat plate-shaped dielectrics constituting the circularly polarized wave antenna concerned, and component elements regarded as identical to those in FIGS. 1 and 2 are designated by the identical reference numerals.

In a circularly polarized wave antenna 21 shown in FIG. 4, the four flat plate-shaped dielectrics 23 having the same shape are combined to constitute the rectangular cylindrical body 5. This flat plate-shaped dielectric 23 is obtained by forming a dielectric material such as ceramic into such a shape as shown in FIG. 5. The outer wall surface of the flat plate-shaped dielectric 23 is a square having the length D of one side, and a radiation conductor 4 inclined by about 45° is formed there by a technique such as printing. Also, as regards an inner wall surface of the flat plate-shaped dielectric 23, the height dimension is D, but the width dimension is as small as D−2t (where t is the plate thickness) In other words, the circularly polarized wave antenna 21 is similar to the above-described first embodiment in the shape and size of the rectangular cylindrical body 5 including the penetration hole 5A as well as the disposition position, length and the like of the radiation conductor 4, but is different from the first embodiment in the shape and combination method of those four flat plate-shaped dielectrics 23. The flat plate-shaped dielectric 23 is likely to generate some strains in both sides during calcination, and is also somewhat inferior to the first embodiment in positioning at the time of the combination, but in other respects, substantially similar effects to the first embodiment can be expected.

The present invention is implemented in such forms and styles as described above, and exhibits such effects as described hereinafter.

Since there are provided radiation conductors on each outer wall surface of four flat plate-shaped dielectrics arranged in a square-cylinder shape, a mechanical orthogonal relationship of each radiation conductor is retained so that deterioration in the antenna characteristics and the poor connection resulting from external vibrations can be reduced, and the required length of the radiation conductor can be shortened by a shortened wavelength due to the flat plate-shaped dielectric having high specific inductive capacity. Also, since the flat plate-shaped dielectric is not likely to unevenly contract in the calcination process during manufacture, it is also easy to perform fine adjustment of the plate thickness and the like by polishing after the calcination, and it becomes easy to prevent variations in the antenna characteristics resulting from dimensional error or the like. Further, since it is easy to print the radiation conductor on a flat surface which serves as the outer wall surface of the flat plate-shaped dielectric, it is possible to easily form a desired radiation conductor. Accordingly, it is possible to provide a circularly polarized wave antenna at low prices which is suitable for miniaturization and resistant to vibrations.

What is claimed is:

1. A circularly polarized wave antenna, comprising four flat plate-shaped dielectrics having the substantially same thickness vertically provided on a printed substrate and arranged in a square-cylinder shape as a whole, and a radiation conductor provided on each outer wall surface of the flat plate-shaped dielectrics and inclined in a fixed direction, wherein a lower end of each of the radiation conductors is electrically connected to the printed substrate and the radiation conductors are configured to receive in-phase electric power.

2. The circularly polarized wave antenna according to claim 1, wherein of a pair of the flat plate-shaped dielectrics adjacent substantially at right angles, a protrusion for protruding from a side of one flat plate-shaped dielectric by a portion corresponding to the plate thickness is fitted into a recess obtained by cutting only a portion corresponding to the plate thickness in a side of the other flat plate-shaped dielectric.

3. The circularly polarized wave antenna according to claim 1, wherein four of the flat plate-shaped dielectrics are all of the same shape.

4. The circularly polarized wave antenna according to claim 2, wherein four of the flat plate-shaped dielectrics are all of the same shape.

5. The circularly polarized wave antenna according to claim 3, wherein an upper half of one side and a lower half of another side of the flat plate-shaped dielectric are cut by a portion corresponding to the plate thickness along a direction of a width.

6. The circularly polarized wave antenna according to claim 4, wherein an upper half of one side and a lower half of another side of the flat plate-shaped dielectric are cut by a portion corresponding to the plate thickness along a direction of a width.

* * * * *